US005111633A

United States Patent [19]

Draghetti

[11] Patent Number: 5,111,633

[45] Date of Patent: May 12, 1992

[54] DEVICE FOR APPLYING STRIPS OF MATERIAL OF PACKETS OF SUBSTANTIALLY PARALLELEPIPED SHAPE

[75] Inventor: Fiorenzo Draghetti, Medicina, Italy

[73] Assignee: G. D. Societa Per Azioni, Bologna, Italy

[21] Appl. No.: 628,223

[22] Filed: Dec. 17, 1990

[30] Foreign Application Priority Data

Dec. 18, 1989 [IT] Italy ..... 3771 A/89

[51] Int. Cl.[5] ..... B65B 61/00

[52] U.S. Cl. ..... 53/136.1; 53/136.4; 53/389.1; 53/64; 156/486

[58] Field of Search ..... 53/136.1, 136.4, 64, 53/389.1; 156/479, 486, 489

[56] References Cited

U.S. PATENT DOCUMENTS

| | | | |
|---|---|---|---|
| 1,261,595 | 4/1918 | Mulet | 156/486 |
| 2,259,445 | 10/1941 | Arelt | 53/136.1 |
| 3,834,970 | 9/1974 | Mitsuoka | 156/489 |
| 4,086,744 | 5/1978 | Seragnoli | 53/136.4 |
| 4,415,399 | 11/1983 | Geisinger | 156/486 X |
| 4,605,459 | 8/1986 | Voltmer | 156/489 X |
| 4,758,301 | 7/1988 | Inoko | 156/486 X |

FOREIGN PATENT DOCUMENTS

| | | | |
|---|---|---|---|
| 0034790 | 9/1981 | European Pat. Off. . | |
| 2150167 | 4/1972 | Fed. Rep. of Germany | 53/136.1 |
| 931753 | 7/1963 | United Kingdom | 53/136.4 |
| 2055747 | 3/1981 | United Kingdom . | |

*Primary Examiner*—John Sipos

*Attorney, Agent, or Firm*—Cushman, Darby & Cushman

[57] ABSTRACT

A device for attaching gummed tear strips to flip top cigarettes packets includes a feed system, by which packets are directed toward a station where the strips are affixed, and a unit by which the strips themselves are fed to the station, typically by a drum revolving substantially tangentially to with the station and incorporating peripheral suction bosses by which the individual strips are held in position on a cylindrical surface. Each single strip affixed is folded and flattened by a blade, associated with the corresponding suction boss and reciprocated radially by a respective mechanical linkage between an inactive position, fully retracted from the cylindrical surface of the drum and an extended operating position assumed upon arrival at the affixing station.

9 Claims, 3 Drawing Sheets

FIG.3
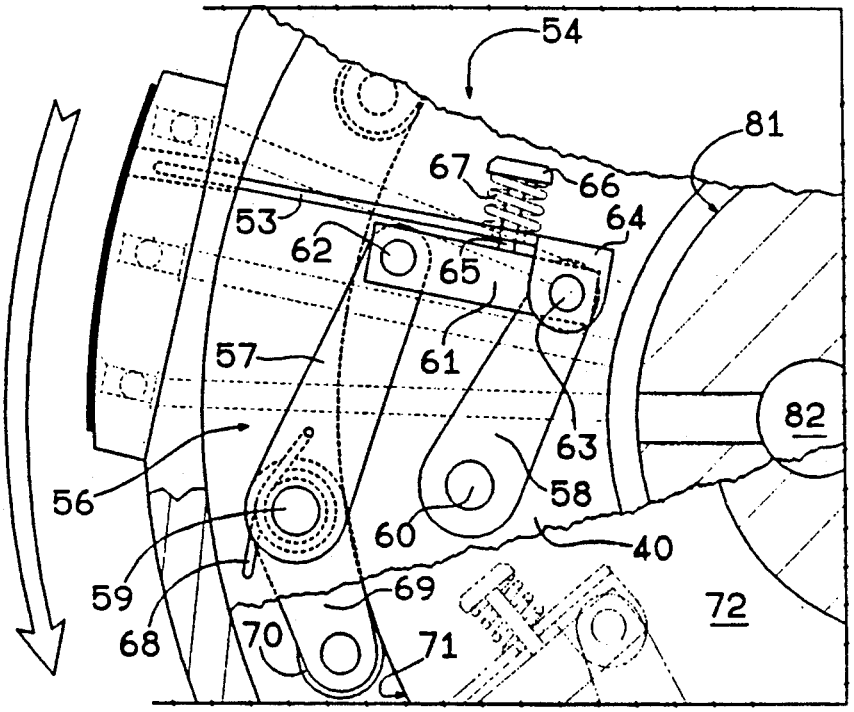
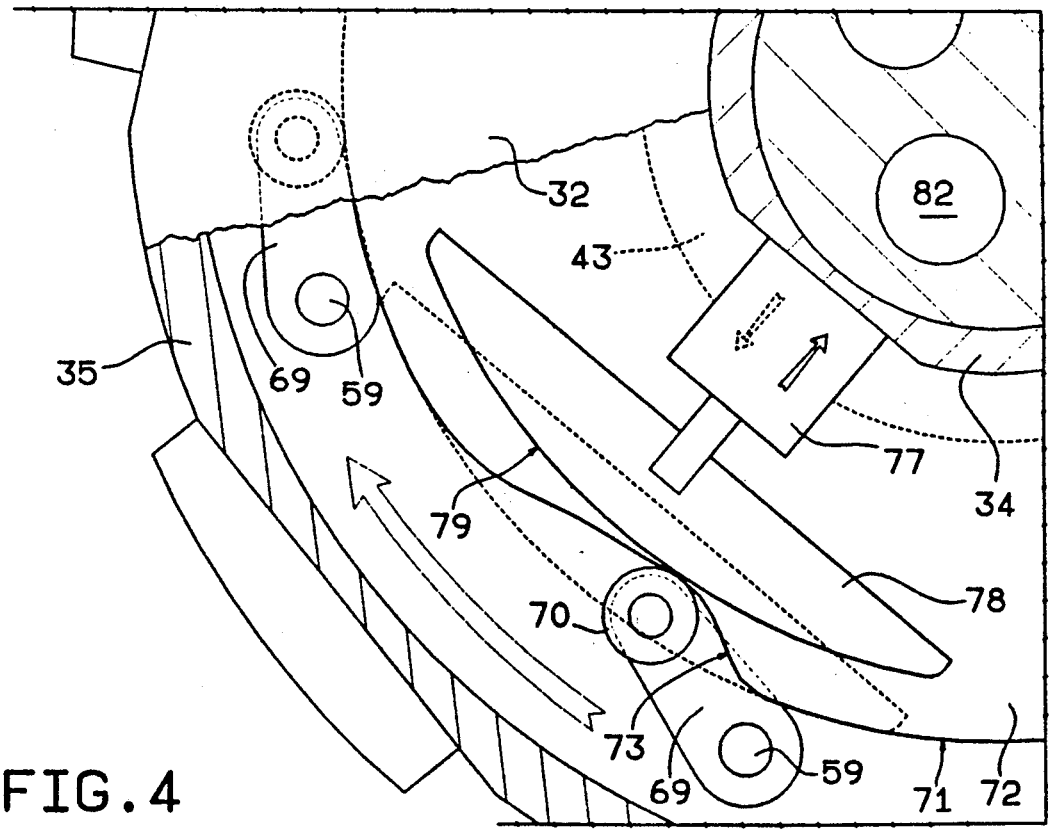
FIG.4

DEVICE FOR APPLYING STRIPS OF MATERIAL OF PACKETS OF SUBSTANTIALLY PARALLELEPIPED SHAPE

BACKGROUND OF THE INVENTION

The present invention relates to a device by means of which to apply strips of material to packets of substantially parallelepiped shape.

In particular, the invention relates to a device for attaching a gummed strip across one edge of a cigarette packet, and more exactly, transversely to the longitudinal dimension of the packet, so as to adhere partly to one side face and partly to the adjacent front face.

The cigarette packets with which the present invention is concerned are those of flip-top type embodiment, including a box and a lid associated one with the other by way of a hinge fold.

In the event that the strip performs the function of a seal, it is laid over the edge interface between the lid and the box, in such a way that the lid cannot be raised unless the strip is torn through.

EP-34 790 discloses a device for applying strips of material to cigarette packets after the fashion outlined above, i.e. across one edge, in which the station where the strips are affixed is supplied with packets accommodated by the radial pockets of an indexing wheel.

The strips are supplied to the station by means of a vacuum roller disposed substantially tangential to the indexing wheel in such a way that upon arrival of each pocket at a selected location, a previously gummed strip is attached, transversely disposed, to the flank or side face of the corresponding packet. This accomplished, a given portion of the strip is left projecting beyond the longitudinal edge of the packet, ready to be folded over and flattened down against the adjacent face.

The operation is completed at a subsequent pause of the indexing wheel, when the packet is ejected from the pocket by a radial push rod and directed into a runout channel, whereupon the projecting portion of the strip is promptly folded down and held in place against the uppermost face of the packet by the top surface of this same channel.

Besides being subject to the limitations on speed imposed by intermittent operation, such a device is beset by other drawbacks.

First, the fact that the runout channel is designed to fold and restrain the projecting portion of the strip dictates that it be substantially equal in height to the depth of the packet; thus, the faces of the packet can be defaced by the channel walls. Moreover, friction between the top of the channel and the projecting portion of the strip can result in the strip itself slipping out of its correct position, or even becoming detached from the packet altogether.

SUMMARY OF THE INVENTION

The object of the present invention is to overcome the drawbacks described above in connection with devices embraced by the prior art.

The stated object is comprehensively realized in a device for applying strips of material to packets of substantially parallelepiped shape, according to the present invention.

Such a device comprises a system of conveyors by which packets are directed toward a station where the strips are affixed, and a feed unit by which single strips are supplied to the affixing station. Advantageously, the unit incorporates a rotary conveyor or drum revolving substantially in tangential conjunction with the affixing station and is equipped with suction bosses by means of which to detain the single strips.

The device disclosed comprises means associated with each of the suction bosses and serving to fold the detained strip, which means are capable of movement substantially in a radial direction relative to the rotating drum, and operating means by which to bring about such movement, between a position of full retraction within the dimensional compass of the drum and an extended working position, assumed at the affixing station, of projection from the dimensional compass of the rotary conveyor.

BRIEF DESCRIPTION OF THE DRAWINGS

The invention will now be described in detail, by way of example, with the aid of the accompanying drawings, in which:

FIG. 3 shows an enlarged detail of FIG. 1;

FIG. 4 shows a further enlarged detail of FIG. 1, seen from the rear.

DESCRIPTION OF THE PREFERRED EMBODIMENTS

Figure 1:
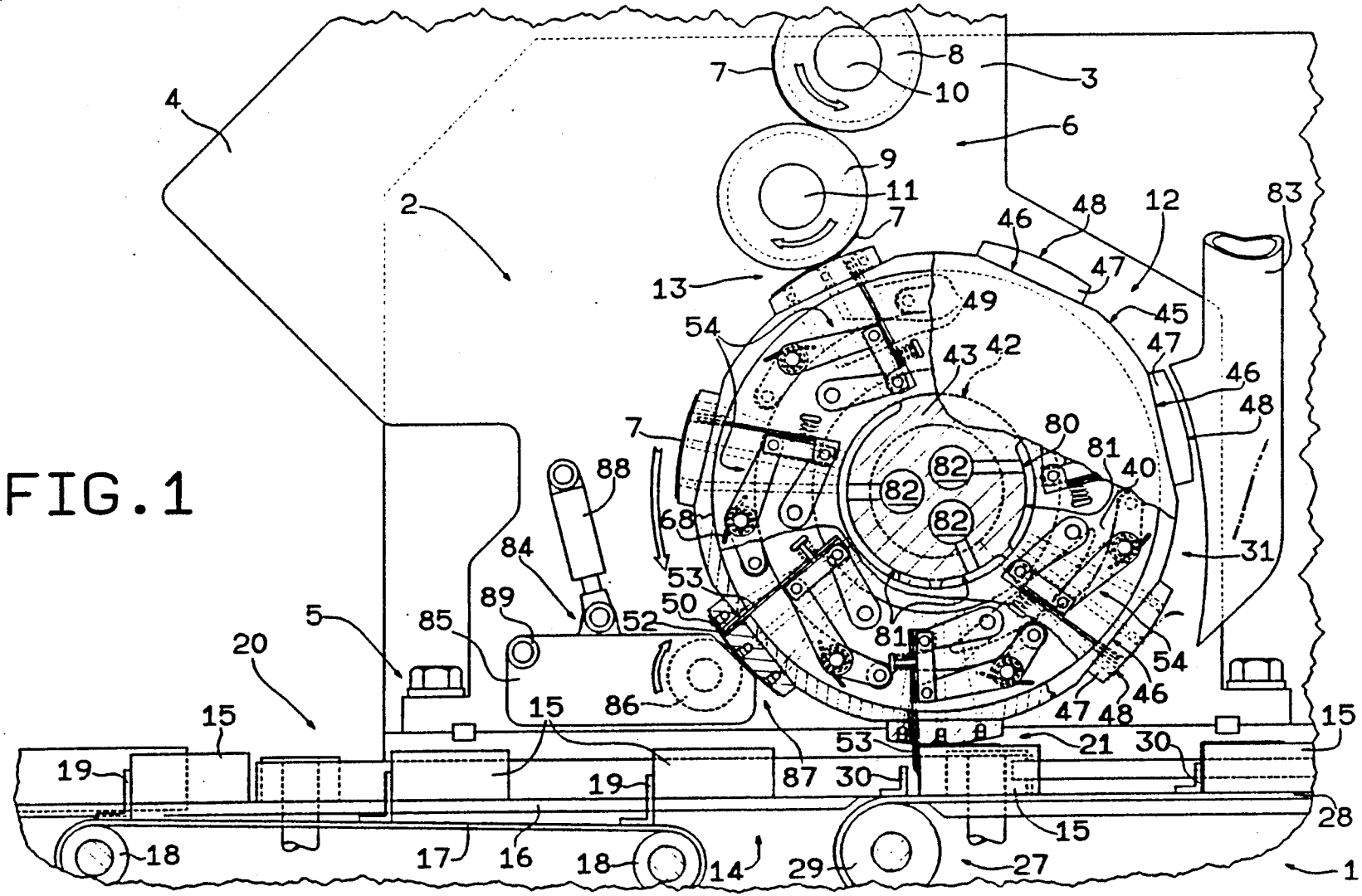
FIG. 1 is the elevation of an embodiment of the device according to the invention.
Figure 2:
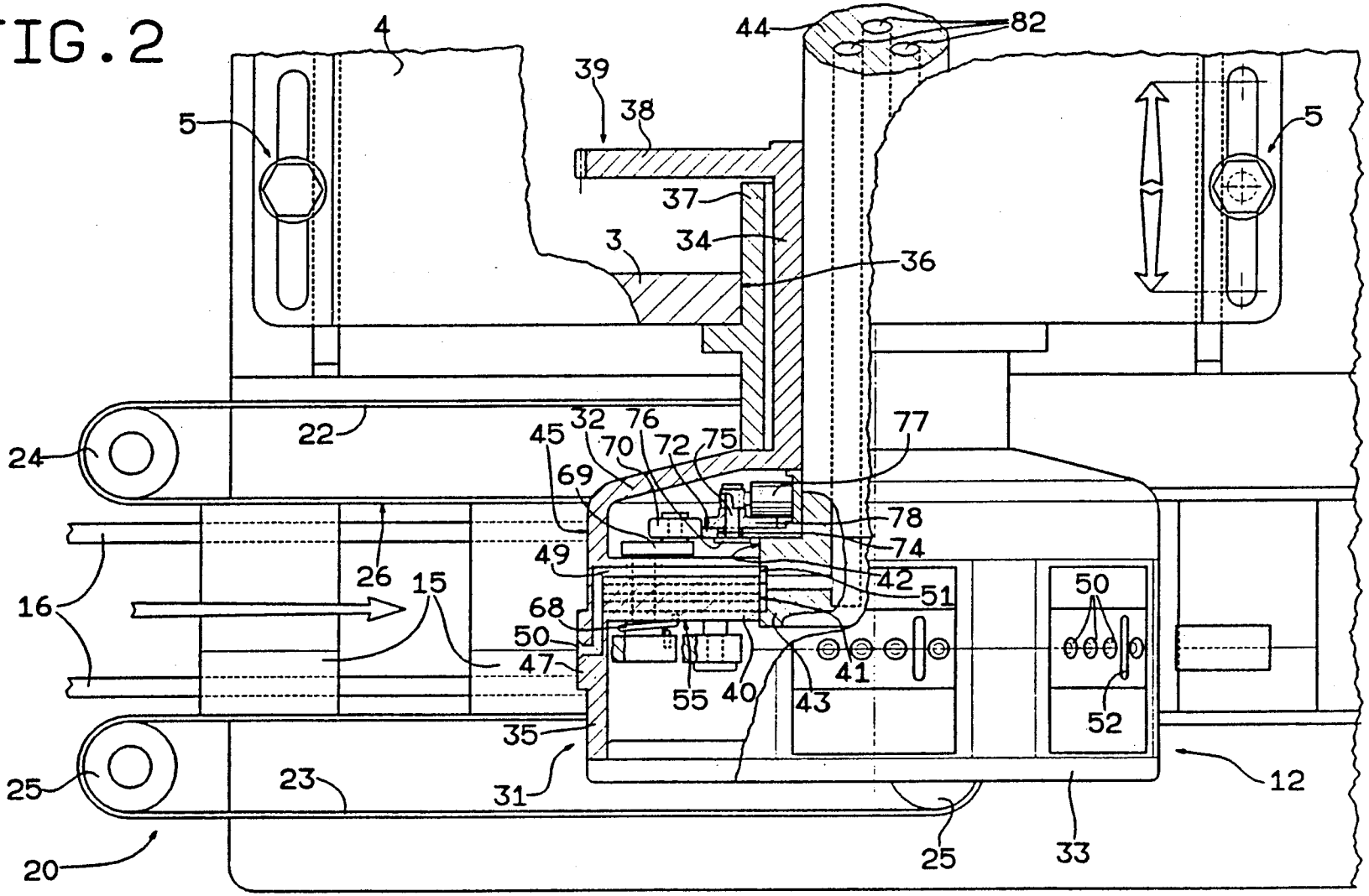
FIG. 2 is a plan showing the device of FIG. 1, with certain parts omitted.

With reference to FIG. 1 and FIG. 2 of the drawings, the numeral 1 denotes the main frame, in its entirety, of a machine such as a wrapper, by which packets of cigarettes are enveloped in sheets of transparent material. One part of such a machine includes in a device 2 for applying a strip of material to each packet of cigarettes.

The numeral 3 denotes the vertical bulkhead of a casing 4 that is mounted to the main frame 1 by way of adjustable means 5 of which the purpose will become clear in due course.

The device 2 comprises a unit 6 designed to feed substantially rectangular strips 7 of material supplied from a stack or a reel (not illustrated in the drawings).

The feed unit 6 is mounted to the bulkhead 3, and comprises two rotary conveyors or feed rollers denoted 8 (upper) and 9 (lower), positioned one substantially tangential to the other and turning about respective shafts 10 and 11 disposed normal to the bulkhead 3. Each roller 8 and 9 connects with conventional means (not illustrated) by which negative pressure is generated through openings located in its cylindrical surface, in such a way that the strips 7 are made to cling fast.

The numeral 12 denotes a further conveyor or drum constituting a part of the feed unit 6, disposed substantially tangential to the lower roller 9 at a station 13 where the strips 7 are transferred, and rotatable about a shaft parallel to shafts 10 and 11 above.

The numeral 14 denotes a feed system by which packets 15 of cigarettes are conveyed lying flat, each with its greater longitudinal axis transversely disposed, in direct contact with a horizontal surface afforded by rails 16 set apart at a given distance one from the other and extending in a direction parallel with the bulkhead 3, perpendicular to the roller shafts 10 and 11. The system 14 comprises a belt conveyor 17 looped around end pulleys 18 positioned beneath the rails 16, of which the axes of rotation lie normal to the bulkhead 3. The belt 17 is angled downwards in the conveying direction, and furnished with a plurality of projections 19 set apart at identical distance one from the next, designed to occupy the space between the rails 16.

The system 14 also comprises a second conveyor 20, extending from a position near to the entry end of the first conveyor 17 (to the left of FIG. 1) to a station 21 located beneath the drum 12, at which the strips 7 are affixed to the packets 15.

As illustrated in FIG. 2, the conveyor 20 includes two belts 22 and 23 looped around respective end pulleys 24 and 25 with vertically disposed axes, of which the innermost branches lie on either side of the rails 16 and create a channel substantially equal in width to the longitudinal dimension of the single packet 15.

The numeral 27 denotes a conveyor positioned beyond the second conveyor 20 along the feed path (arrowed at left of FIG. 2), by which the packets 15 are directed toward wrapping means (not illustrated in the drawings). Disposed substantially in alignment with the angled conveyor 17, this conveyor 27 likewise includes a belt 28 looped around pulleys 29 (one of which is shown in FIG. 1) positioned below the plane defined by the rails 16, rotatable about horizontal axes, and is furnished with a plurality of projections 30 spaced apart at equal distance one from the next which protrude above the level of the rails 16. More precisely, the uppermost surface of the top branch of the belt loop 28 occupies the same plane as that occupied by the uppermost surfaces of the rails 16; also, the rails will be seen to terminate immediately preceding the station 21 at which the strips 7 are affixed, marginally short of the entry end of the conveyor 27 (the left hand end as viewed in FIG. 1).

The drum 12 comprises an external bell housing 31 of substantially cylindrical shape, of which the end directed toward the bulkhead 3 is enclosed by a integrally embodied web 32, and the opposite end enclosed by a removable cover 33. The housing is associated with a tubular appendage 34 disposed coaxial with the cylindrical side wall 35 of the housing 31 and extending from the web 32 toward the bulkhead 3. The bulkhead in turn affords a through hole 36 and a fixed sleeve 37, lodged in the hole, by which the tubular appendage 34, is rotatably accommodated. The end of the appendage 34, on the side of the bulkhead 3 farthest from the housing 31, is rigidly associated with a gear 38 constituting the final component of a drive system 39 by which the drum 12 is set in rotation about its own axis in the anticlockwise direction, as viewed in FIG. 1. The numeral 40 denotes an annular cylindrical element of which the outer peripheral surface is rigidly associated with the inner surface of the cylindrical wall 35 of the housing 31 and the inner surface 41 breasted rotatably with a matching surface 42 offered by the cylindrical head 43 of a shaft 44 that extends from the housing 31 through the tubular appendage 34 and is supported in a fixed position by the casing 4. The drum wall 35 presents a cylindrical exterior surface 45 affording a plurality of flat areas 46 spaced apart at identical angular distances, each constituting a base on which to position respective means for detaining a single strip 7 that include a boss 47 rigidly associated with the wall 35 and exhibiting an outward-facing surface 48 of which the profile coincides with a cylinder coaxial to the drum 12.

The numeral 49 denotes one of a plurality of radially disposed ducts passing through the annular element 40 and the cylindrical wall 35 and through each boss 47, which each terminate in respective external ports 50 located in the surface 48 of each boss, and in respective internal ports 51 afforded by the inner surface 41 of the annular element 40. Also passing through each boss 47 and the cylindrical wall 35 beneath is a single radial slot 52, approximately rectangular in shape, of which the greater axis is disposed parallel with the axis of rotation of the drum 12.

Each slot 52 affords passage to a respective blade or folder 53 capable of movement in relation to the drum 12 through a substantially radial trajectory, operated by respective mean denoted 54 in their entirety, between a retracted position in which the folder 53 lies fully within the dimensional compass of the drum 12, and an extended position in which the folder 53 projects from the surface 48 of the relative boss 47.

As discernible from FIGS. 1, 2 and 3, the folder operating means 54 are associated with one lateral surface of the annular element 40 and each include a parallelogram linkage 56 comprising two crank arms 57 and 58 with first ends anchored to the annular element 40 by way of respective pivots 59 and 60, and the remaining ends connected to one end of a rod 61 by way of further respective pivots 62 and 63. The rod 61 lies substantially in parallel contact with an innermost end of the folder 53, of which the innermost extremity affords a clevis 64 connected with the pivot denoted 63. In addition, the rod 61 is coupled permanently to the folder 53 at an intermediate point along its length by way of a bolt 65, integral with the rod at one end and extending perpendicular both to the rod and to the axis of the drum 12 through a slot afforded by the folder 53. The remaining end of the bolt 65 affords an enlarged head 66 against which to seat a coil spring 67, compressed between the folder 53 and the head 66 itself in such a manner as to maintain the folder 53 in elastically compliant association with the rod 61.

The pivot denoted 59 (see FIG. 2) passes freely through the annular element 40, and is rotatable thus about its own axis in relation to the element, against the action of a spiral spring 68. A first end of the pivot 59 is rigidly associated with the relative crank arm 57, while the remaining end, positioned on the opposite side of the annular element 40, is rigidly associated with one end of a lever 69 of which the unattached end carries a cam following roller 70.

The following roller 70 is urged by the spring 68 into contact with the profiled surface 71 of a cam disk 72 keyed to the fixed shaft 44. The surface 71 is approximately cylindrical, and will be seen to exhibit a recess 73 located substantially facing the affixing station 21 (see FIG. 4), which, when engaged by a given following roller 70, causes the relative folder 53 to extend from the normally retracted position to the projecting position and thereafter to return to the retracted position. As shown in FIG. 1, and more particularly in FIGS. 2 and 4, the cam disk 72 has a through slot 74 positioned substantially in radial alignment with the recess 73 and extending radially across the disk, which accommodates a transversely slidable pin 75 disposed parallel to the axis of the drum 12 and having a head 76, at the end directed toward the annular element 40, of dimensions greater than the transverse dimension of the slot 74. The end of the pin 75 opposite from the head 76 is coupled to the reciprocating member of a linear actuator 77 mounted to the disk 72 and radially orientated. The numeral 78 denotes a plate keyed to an intermediate part of the pin 75 and associated slidably with the surface of the cam disk 72 directed toward the web 32 of the bell housing 31. The surface 79 of the edge of the plate 78 facing the cylindrical wall 35 of the housing 31 is of approximately cylindrical geometry, its radius of curvature substantially identical to that of the profile surface 71 of the cam disk 72, while the length and positioning of the slot 74 are such as to enable movement of the surface 79 in relation to the disk 72, when brought about by the actuator 77, between a retracted position whereby the surface 79 is placed wholly to the rear of the recess 73, and an extended position in which this same surface 79 and the profile surface 71 coincide substantially and the followers 70 are prevented from entering the recess 73.

The actuator 77 and the plate 78 thus provide means of inhibiting the extending and retracting movement of the folders 53 and their operating means 54. The drum 12 is equipped with a pneumatic circuit, denoted, in its entirety, by the numeral 80, by means of which to handle the strips 7. Such a circuit comprises a plurality of chambers 81 located in the surface 42 of the cylindrical head 43, which are caused to connect with the radial ducts 49 on the one hand, and with respective axial ducts 82 routed along the interior of the shaft 44 on the other.

The numeral 83 denotes an extractor hood located alongside the drum 12 at a point beyond the affixing station 21, in relation to the direction of rotation, which is connected to means of generating suction (not shown in the drawings).

The numeral 84 denotes a gumming device comprising a tank 85 filled with a supply of glue, and an applicator roller 86 disposed with its axis parallel to the axis of the drum 12, which rotates substantially tangential to the cylindrical surface 48 described by the bosses 47 at a gumming station 87 preceding the affixing station 21.

In operation, the strips 7 are fed downwards from above by way of the rollers 8 and 9, as illustrated in FIG. 1, toward the periphery of the drum 12, and deposited singly and succession on the surfaces 48 of the bosses 47, where they remain positioned in conventional manner by means of suction generated through the ducts 49.

Once stably detained on the relative boss 47, the strip 7 is rotated without pause by the drum 12 to the gumming station 87, where its outward-facing surface is coated with glue by the applicator 86, thence to the affixing station 21 where a relative packet 15 is encountered. As the strip 7 approaches the station 21, in fact, the packet 15 will be progressing continuously at a first speed along the first conveyor 17 prior to being taken up by the channel conveyor 20 and moved toward the affixing station 21, still at the same speed, to coincide with the arrival of the strip 7, and finally, directed fully into the station 21 by the conveyor denoted 27 at a speed greater than the first speed. More exactly, it will be observed from FIG. 1 that each packet 15 reaches the affixing station 21 marginally ahead of the relative strip 7, such that when occupying the station, the strip 7 is placed in contact with the larger face of the packet 15 not in its entirety, but with one end projecting to the rear of the hindmost edge of the packet, the edge in question occupying a position fractionally forward from the slot 52 of the relative boss 47 as considered in the direction of movement followed by the drum 12 and the feed system 14.

Immediately prior to the moment when the packet 15 and the relative boss 47 assume the configuration described above at the affixing station 21, the cam follower 70 of the relative operating means 54 will engage the recess 73 in the cam disk 72, displacing the folder 53 from the retracted position to the extended position. Extending thus, the folder 53 impinges on the end portion of the relative strip 7 projecting to the rear and flattens it against the corresponding upright flank of the packet 15. In particular, it will be noted that when a single boss 47 reaches the affixing station, the suction hitherto generated through the ducts 49 of the relative boss 47 is cut off, allowing the strip 7 to separate from the surface 48 such that the rear end portion can be folded and flattened while the remaining length is held firmly in position against the boss 47 by mechanical pressure resulting from the mutual contact between the boss 47 and the packet 15.

In this way, the strip 7 is prevented from slipping axially when engaged by the extending folder 53 in the course of its being flattened, and assuming an incorrect position in contact with the relative packet 15. A correct positioning of the strip 7 on the relative packet 15 is assisted further by the spring-tensioned association of the folder 53 with the rod 61 of the operating means 54 (see FIG. 3), the effect of which is to reduce sliding friction between folder 53 and strip 7.

With the end portion of the strip 7 flattened, the folder 53 reassumes its retracted position as a result of the relative following roller 7 emerging from the recess 73, while the end portion itself is kept firmly in contact with the flank of the packet 15 by a corresponding projection 30 of the successive conveyor 27, which proceeds to distance the packet 15 from the station 21 with its strip 7 correctly affixed.

Given that, during its passage through the affixing station 21, the packet 21 is secured in position exclusively by frontal contact of the ends with the belts of the channel 26, the entire expanse of the uppermost and rear faces remains clear to accept a relative strip 7. Accordingly, the exact location of the strip on the packet 15 can be varied freely by suitable adjustment of the means 5 provided for positioning the casing 4.

In the event of the drum 12 ceasing to rotate for whatever reason, the presence of any strips 7 still in place between the applicator roller 86 and the affixing station 21 ma prohibit the resumption of normal production. The glue applied to the strips 7 will dry out, in effect, and fail to adhere to the packets 15, the result of which being to cause a blockage of the packet supply line.

To the end of ensuring that such an occurrence is avoided on resuming production, any gummed strips 7 that have dried out are allowed to run through the affixing station 21 without cutting off suction through the relative ducts 49, and are discarded beyond the station 21 upon arrival at the extractor hood 83. The folders 53 and the operating means 54 relative to the defective strips are inhibited by activating the actuator 7 to traverse the plate 78 into the extended position.

Finally, in certain emergency conditions (e.g. the absence of strips 7 and/or packets 15), it may be desirable to bypass the gumming device 84. This can be accomplished by an actuator 88 interlocked to conventional monitoring means (not illustrated), that will cause the tank 85 to rotate about a pivot 89 and thus distance the applicator roller 86 from its position tangential to the surfaces 48 of the bosses 47.

In the event of both actuators 77 and 78 operating at one time, any unused strips 7 will remain free of damage and thus can be recovered.

What is claimed:

1. A device for applying strips of material bearing adhesive on a face thereof, to packets of substantially parallelepiped shaped each having a face and an end, which intersect at a corner, said device comprising:

a station at which strips are affixed singly and in succession to respective ones of said packets;

a feed system by which said packets are directed singly and in succession toward the affixing station with said face of each said packet oriented toward affixing station and said end thereof trailing;

a feed unit, by which strips bearing adhesive on a face thereof are supplied singly to the affixing station with said face thereof presented radially outwards, said feed unit including a rotary conveyor revolving about an axis so as to have a radially outer periphery moved substantially tangentially to the affixing station and equipped on said outer periphery with a plurality of detaining means for successively temporarily detaining individual ones of said strips, each said detaining means having a continuous, radially outer peripheral surface for supporting the whole length of said strip and for pressing a portion of said strip against the face of the packets, suction means for temporarily holding each strip by suction facewise against said radially outer peripheral surface of a respective said detaining means as said feed unit is rotated about said axis from a strip-accepting position, to said affixing station;

folding means respectively associated with each of said detaining means and serving to fold a respective detained strip; means mounting each said folding means for substantially radial movement in relation to said rotary conveyor; and operating means radially moving each said folding means between a retracted position in which the respective folding means lies retracted within the radially outer perimeter of said rotary conveyor, and a working position, temporarily assumed at said affixing station, in which the respective folding means is extended so as to project radially outwardly beyond the outer perimeter of said rotary conveyor through a respective said outer peripheral surface of a respective said detailing means so as to momentarily adjacently trail a said end of a respective said packet, thereby folding a respective said strip around a respective said corner into affixing relation with both a said face and a said end of a respective said packet.

2. The device of claim 1, wherein:

said feed system comprises conveyor means which engage respective said ends of which are disposed normal to the axis of rotation of said rotary conveyor.

3. The device of claim 2, wherein:

said conveyor means comprises a conveyor having a carrying run which advances in along a feed direction and has a plurality of projections which engage respective said ends of respective ones of said packets.

4. The device of claim 2, further comprising:

means by which the position of said feed unit for supplying strips to the affixing station can be adjusted longitudinally with relation to said axis of rotation of said rotary conveyor.

5. The device of claim 1, further comprising:

means for inhibiting the means by which the folding means are operated for preventing affixation of certain of said labels to certain of said packets.

6. The device of claim 1, wherein:

respective ones of said folding means are mounted to the respective said operating means so as to be elastically compliant with respect thereto.

7. The device of claim 5, further comprising:

suction means located beyond said affixing station in the direction of rotation of the rotary conveyor and serving to remove strips which have not been affixed to respective ones of said packets, from said rotary conveyor.

8. The device of claim 1, further comprising a device for applying gum to said faces of said strips while said strips are associated with the detaining means for causing said strips to bear adhesive on said faces thereof, and further comprising actuator means for deactivating said gum-applying device.

9. The device of claim 5, further comprising a device for applying gum to said faces of said strips while said strips are associated with the detaining means for causing said strips to bear adhesive on said faces thereof, and further comprising actuator means for deactivating said gum-applying device.

* * * * *